US007430387B2

(12) United States Patent
Kim et al.

(10) Patent No.: US 7,430,387 B2
(45) Date of Patent: Sep. 30, 2008

(54) DEVELOPING UNIT AND ELECTROPHOTOGRAPHIC IMAGE FORMING APPARATUS WITH THE SAME

(75) Inventors: Jin-hong Kim, Incheon (KR); Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 185 days.

(21) Appl. No.: 11/384,539

(22) Filed: Mar. 21, 2006

(65) Prior Publication Data

US 2006/0257167 A1 Nov. 16, 2006

(30) Foreign Application Priority Data

May 10, 2005 (KR) ..... 10-2005-0039001

(51) Int. Cl.
*G03G 15/00* (2006.01)

(52) U.S. Cl. ..... 399/167

(58) Field of Classification Search ..... 399/111, 399/167, 222, 254, 265, 272, 279, 281
See application file for complete search history.

(56) References Cited

U.S. PATENT DOCUMENTS 6,704,529 B2 3/2004 Noh

FOREIGN PATENT DOCUMENTS

| | | |
|---|---|---|
| JP | 5-281858 | 10/1993 |
| JP | 10-171331 | 6/1998 |
| JP | 2003-337472 | 11/2003 |
| KR | 2002-68429 | 8/2002 |

*Primary Examiner*—David M. Gray
*Assistant Examiner*—Kristofferson Service
(74) *Attorney, Agent, or Firm*—Stein, McEwen & Bui, LLP

(57) ABSTRACT

A developing unit and an electrophotographic image forming apparatus with the same, the developing unit having a simple structure for driving internal rotary components. In the developing unit, a photoconductor gear is formed on a side of a photoconductor to be rotated by an external driving force, a developer roller gear is formed on a side of a developer roller and engaged with the photoconductor gear to be rotated by the photoconductor gear, an idle gear is engaged with the developer roller gear to be rotated by the developer roller gear, a toner-supply roller gear is formed on a side of a toner-supply roller and engaged with the idle gear to be rotated by the idle gear, and an agitator gear is formed on a side of an agitator and engaged with the toner-supply roller gear to be rotated by the toner-supply roller gear.

18 Claims, 4 Drawing Sheets

DEVELOPING UNIT AND ELECTROPHOTOGRAPHIC IMAGE FORMING APPARATUS WITH THE SAME

CROSS-REFERENCE TO RELATED APPLICATION

This application claims the benefit of Korean Application No. 2005-39001, filed on May 10, 2005, in the Korean Intellectual Property Office, the entire content of which is incorporated herein by reference.

BACKGROUND OF THE INVENTION

1. Field of the Invention

Aspects of the present invention relate to a developing unit and an electrophotographic image forming apparatus with the same. More particularly, aspects of the present invention relate to a developing unit having a simple structure for driving internal rotary components and an electrophotographic image forming apparatus with the same.

2. Description of the Related Art

Typically, an electrophotographic image forming apparatus, such as a laser printer or a digital copier, radiates a light beam across a photoconductor charged to a predetermined potential to form an electrostatic latent image on the photoconductor, applies toner (a developing agent) to the electrostatic latent image to develop the electrostatic latent image into a visible toner image, transfers the visible toner image to a print medium, and fuses the toner image onto the print medium to print a predetermined image. Such an electrophotographic image forming apparatus includes a developing unit to contain the toner and to develop the electrostatic latent image into a visible toner image by applying the toner to the photoconductor.

FIGS. 1 and 2 are plan views illustrating arrangements of gears for driving rotary components of conventional developers.

Referring to FIG. 1, a developing unit 10, which is an example of a conventional developer, includes a photoconductor gear 11 to drive a photoconductor (not shown), a first idle gear 15 engaged with the photoconductor gear 11, a second idle gear 16 engaged with the first idle gear 15, and a third idle gear 17 engaged with the second idle gear 16. The second idle gear 16 is also engaged with a developer roller gear 12 and a toner-supply roller gear 13. The developer roller gear 12 drives a developer roller (not shown), and the toner-supply roller gear 13 drives a toner-supply roller (not shown). The third idle gear 17 is also engaged with an agitator gear 14 to drive an agitator (not shown).

The photoconductor gear 11 is coupled to an external driving unit (not shown). The external driving unit drives the photoconductor gear 11 clockwise when a printing operation starts. Upon the rotation of the photoconductor gear 11, the idle gears 15, 16, and 17 are rotated. As a result, the developer roller gear 12 and the toner-supply roller gear 13, which are engaged with the second idle gear 16, are rotated counterclockwise, and the agitator gear 14 engaged with the third idle gear 17 is rotated clockwise.

Referring to FIG. 2, a developing unit 20, which is another example of a conventional developer, includes a photoconductor gear 21 coupled to an external driving unit (not shown), a developer roller gear 22 engaged with the photoconductor gear 21, a first idle gear 25 engaged with the developer roller gear 22, and a second idle gear 26 engaged with the first idle gear 25. The first idle gear 25 is also engaged with a toner-supply roller gear 23, and the second idle gear 26 is also engaged with an agitator gear 24.

When an electrophotographic image forming apparatus performs a printing operation, the external driving unit rotates the photoconductor gear 21 clockwise. As a result, the developer roller gear 22 is rotated counterclockwise, the first idle gear 25 is rotated clockwise, and the second idle gear 26 is rotated counterclockwise. The toner-supply roller gear 23 engaged with the first idle gear 25 is rotated counterclockwise, and the agitator gear 24 engaged with the second idle gear 26 is rotated clockwise.

As shown in FIGS. 1 and 2, the developing units 10 and 20 require at least two idle gears as well as gears provided at one side of each of the rotary components to drive each rotary component, such as a photoconductor, a developer roller, a toner-supply roller, and an agitator, thereby increasing the possibility of malfunctions in the developing unit, and the complexity, size, and manufacturing cost of the developing unit. Further, this complicated gear system causes a photoconductor to be rotated at non-uniform speed or periodically vibrated during rotation. Abnormal horizontal lines, known as jitter, may be present in a printed image because of this non-uniform rotation and periodic vibration of the photoconductor.

SUMMARY OF THE INVENTION

Accordingly, aspects of the present invention provide a developing unit having a simple gear train and an electrophotographic image forming apparatus including the developing unit.

Aspects of the present invention also provide a developing unit having a simple gear train that uses a single idle gear and an electrophotographic image forming apparatus with the same.

According to an aspect of the present invention, there is provided a developing unit including: a photoconductor to form an electrostatic latent image thereon; a developer roller to develop the electrostatic latent image into a visible toner image by applying toner to the photoconductor; a toner-supply roller to supply the toner to the developer roller; an agitator to agitate the toner to supply the toner to the toner-supply roller; a photoconductor gear formed on a side of the photoconductor, to be rotated by an external driving force; a developer roller gear formed on a side of the developer roller and engaged with the photoconductor gear to be rotated by the photoconductor gear; an idle gear engaged with the developer roller gear to be rotated by the developer roller gear; a toner-supply roller gear formed on a side of the toner-supply roller and engaged with the idle gear to be rotated by the idle gear; and an agitator gear formed on a side of the agitator and engaged with the toner-supply roller gear to be rotated by the toner-supply roller gear.

According to an aspect of the present invention, the toner-supply roller gear may include: a first gear portion engaged with the idle gear; and a second gear portion formed coaxially with the first gear portion and engaged with the agitator gear, wherein the first gear portion and the second gear portion have different diameters.

According to an aspect of the present invention, the idle gear may include: a first idle gear portion engaged with the developer roller gear; and a second idle gear portion formed coaxially with the first idle gear portion and engaged with the toner-supply roller gear, wherein the first idle gear portion and the second idle gear portion have different diameters.

According to another aspect of the present invention, there is provided an electrophotographic image forming apparatus including a case; a driving unit installed in the case; and a developing unit removably installed in the case, the developing unit including: a photoconductor forming an electrostatic latent image thereon; a developer roller developing the electrostatic latent image into a visible toner image by applying toner to the photoconductor; a toner-supply roller supplying the toner to the developer roller; an agitator agitating the toner to supply the toner to the toner-supply roller; a photoconductor gear formed on a side of the photoconductor, being rotated by the driving unit; a developer roller gear formed on a side of the developer roller and engaged with the photoconductor gear to be rotated by the photoconductor gear; an idle gear engaged with the developer roller gear to be rotated by the developer roller gear; a toner-supply roller gear formed on a side of the toner-supply roller and engaged with the idle gear to be rotated by the idle gear; and an agitator gear formed on a side of the agitator and engaged with the toner-supply roller gear to be rotated by the toner-supply roller gear.

According to an aspect of the present invention, the toner-supply roller gear may include: a first gear portion engaged with the idle gear; and a second gear portion formed coaxially with the first gear portion and engaged with the agitator gear, wherein the first gear portion and the second gear portion have different diameters.

According to an aspect of the present invention, the idle gear may include: a first idle gear portion engaged with the developer roller gear; and a second idle gear portion formed coaxially with the first idle gear portion and engaged with the toner-supply roller gear, wherein the first idle gear portion and the second idle gear portion have different diameters.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
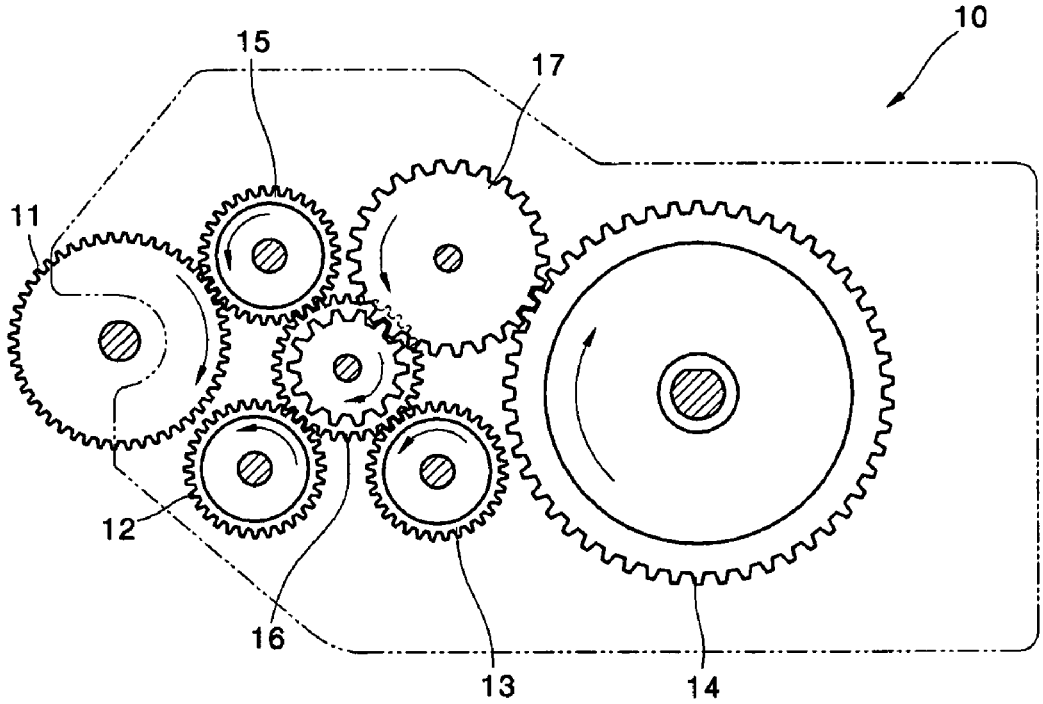
FIG. 1 (PRIOR ART)
FIGS. 1 and 2 are plan views showing trains of gears for driving rotary components of conventional developing units.
Figure 2:
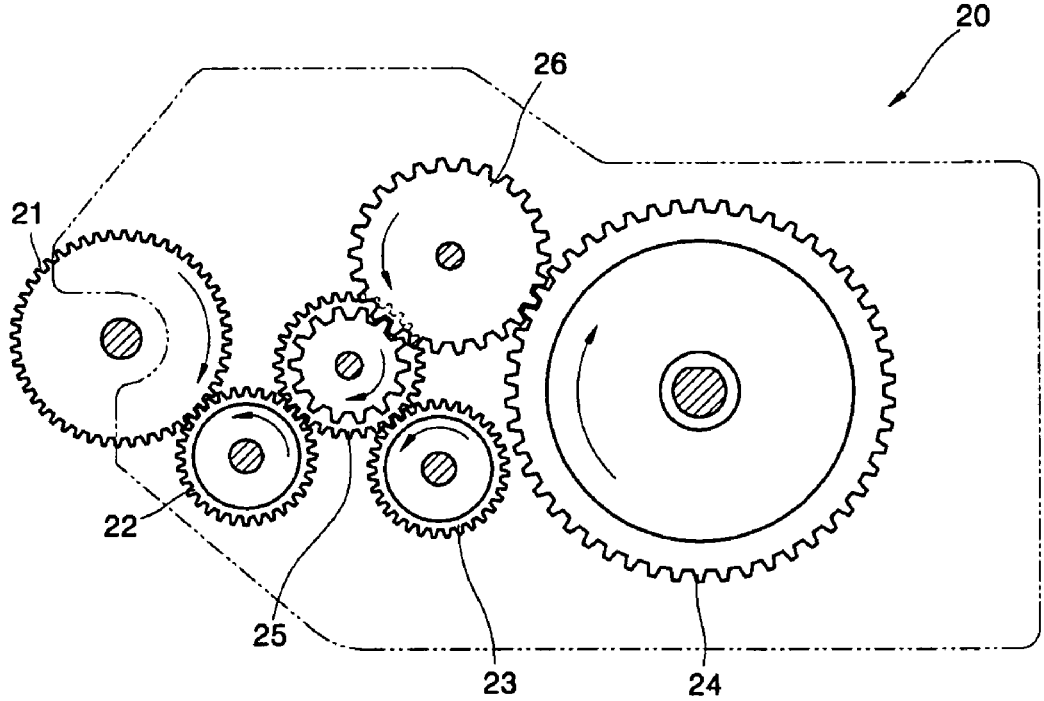
FIG. 2 (PRIOR ART)

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
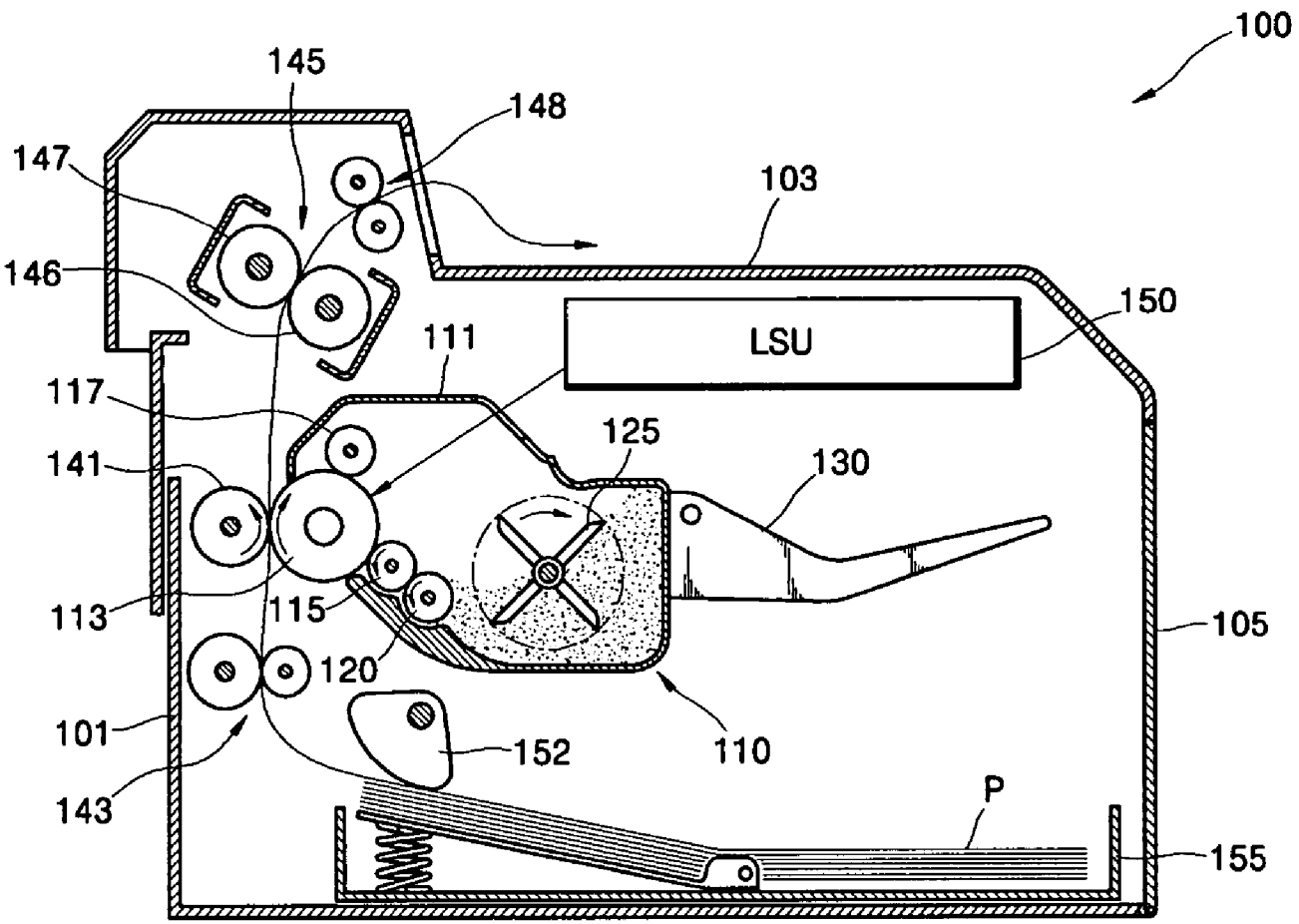
FIG. 3 is a side cross-sectional view of an electrophotographic image forming apparatus according to an embodiment of the present invention.
Figure 4:
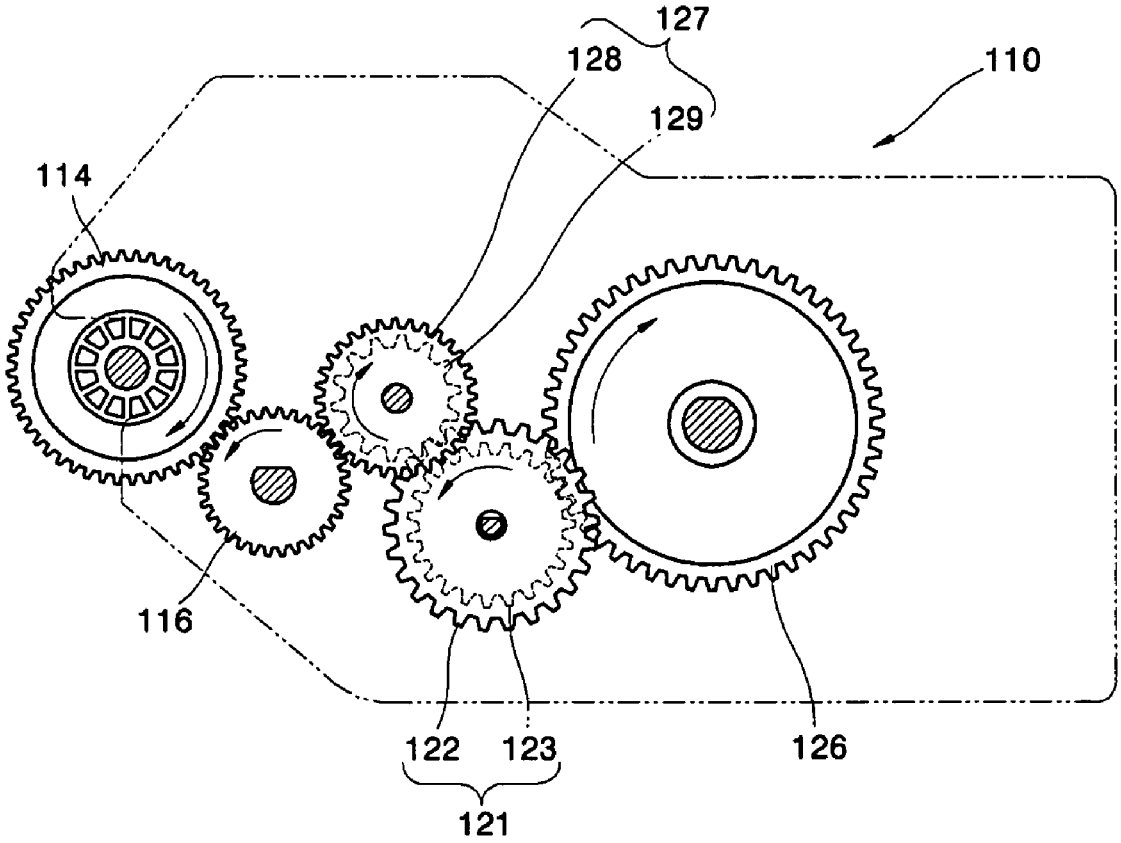
FIGS. 4 and 5 are a plan view and a perspective view, respectively, showing a gear train for driving rotary components of a developing unit of the electrophotographic image forming apparatus depicted in FIG. 3.
Figure 5:
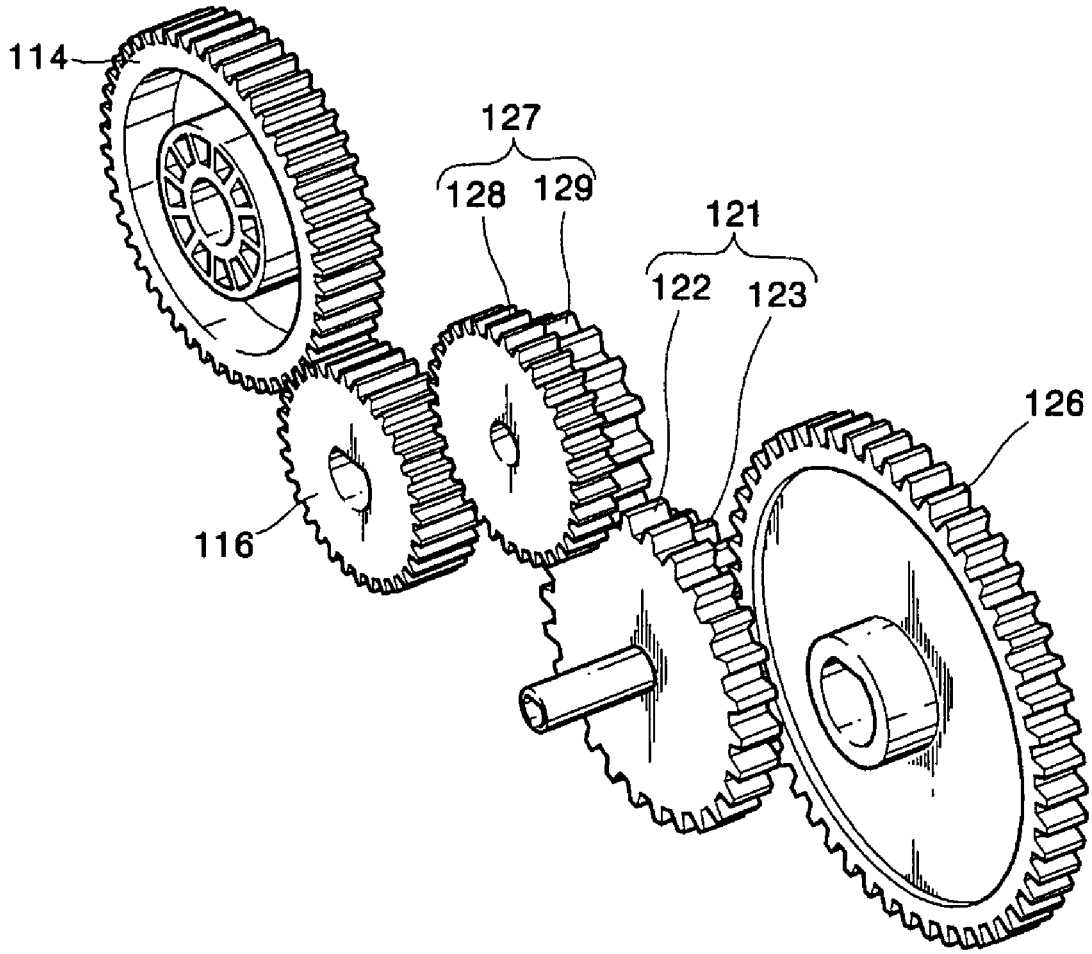

FIG. 3 is a side cross-sectional view of an electrophotographic image forming apparatus 100 according to an embodiment of the present invention, and FIGS. 4 and 5 are a plan view and a perspective view, respectively, showing a gear train for driving rotary components of a developing unit of the electrophotographic image forming apparatus depicted in FIG. 3.

Referring to FIG. 3, the electrophotographic image forming apparatus 100 defines a C-shaped path along which printing media (P) are transported upward. The electrophotographic image forming apparatus 100 includes a case 101 and a developing unit 110 that is detachably installed in the case 101. The electrophotographic image forming apparatus 100 further includes a fuser 145, a transfer roller 141, and a light scanning unit (LSU) 150.

The developing unit 110 may be installed into the case 101 by opening a door 105 and inserting the developing unit 110 into the case 101 through the open door 105 by using a handle 130. The developing unit 110 includes a housing 111, a photoconductor 113, a charge roller 117, and a developer roller 115, a toner-supply roller 120, and an agitator 125. The housing 111 contains toner (a developing agent), the charge roller 117 that charges the photoconductor to a predetermined potential, the photoconductor 113 to form an electrostatic latent image thereon when exposed to a light beam, the developer roller 115 that applies the toner to the electrostatic latent image of the photoconductor 113 to develop the electrostatic latent image into a visible toner image, the toner-supply roller 120 that supplies the toner to the developer roller 115, and the agitator 125 that agitates the toner contained in the housing 111 to prevent the toner from hardening. The developing unit 110 further includes a waste toner cleaner (not shown) to remove waste toner from the photoconductor 113 and a doctor blade (not shown) to regulate a thickness of the toner formed on the developer roller 115. The developing unit 110 is constructed in the form of a cartridge such that it can be easily replaced with a new one when the toner is used up.

The transfer roller 141 faces and contacts the photoconductor 113 to press the print medium (P) against the photoconductor 113 while the print medium (P) is passing between the photoconductor 113 and the transfer roller 113, so that the toner image formed on the photoconductor 113 can be transferred to the print medium (P).

The fuser 145 includes a heat roller 146 and a pressure roller 147 facing the heat roller 146, to apply heat and pressure to the toner image on the print medium (P) to fuse the toner image onto the print medium (P).

The electrophotographic image forming apparatus 100 further includes a cassette 155 to store printing media (P), a pick-up roller 152 to pick up the printing media (P) one by one from the cassette 155, feed rollers 143 to feed the picked-up print medium (P) toward the developing unit 110 and to align the print medium (P) for an exact printing before reaching the photoconductor 113, and eject rollers 148 to discharge the print medium (P) printed with images from the case 101 to an output tray 103.

An operation of the electrophotographic image forming apparatus 100 will now be described. The charge roller 117 charges the photoconductor 113 to a predetermined potential, and the LSU 150 scans the photoconductor 113 with a light beam corresponding to an image to be printed to form an electrostatic latent image on the photoconductor 113. The toner-supply roller 120 supplies toner from the housing 111 to the developer roller 115, and then the developer roller 115 applies the toner to the photoconductor 113 to develop the electrostatic latent image into a visible toner image. Meanwhile, the pick-up roller 152 picks up the printing media (P) one by one from the cassette 155, and the feed rollers 143 feed the picked-up printing media (P) precisely toward the juncture between the photoconductor 113 and the transfer roller 141. While the print medium (P) passes between the photoconductor 113 and the transfer roller 141, the visible toner image is transferred from the photoconductor 113 to the print medium (P). Then, the fuser 145 applies heat and pressure to the toner image on the print medium (P) to firmly attach the toner image to the print medium (P), and the discharge rollers 148 discharge the print medium (P) to the output tray 103.

The developing unit 110 further includes a frame (not shown) at a side of the housing 111 to support some rotary components such as the photoconductor 113, the developer roller 115, the toner-supply roller 120, and the agitator 125.

Referring to FIGS. 4 and 5, the developing unit 110 includes a photoconductor gear 114 formed on a side of the photoconductor 113 to coaxially rotate with the photoconductor 113, a developer roller gear 116 formed on a side of the developer roller 115 to coaxially rotate with the developer roller 115, a toner-supply roller gear 121 formed on a side of the toner-supply roller 120 to coaxially rotate with the toner-supply roller 120, and an agitator gear 126 formed on a side of the agitator 125 to coaxially rotate with the agitator 125. The frame rotatably supports the photoconductor gear 114, the developer roller gear 116, the toner-supply roller gear 121, the agitator gear 126, and an idle gear 127 that is disposed between the developer roller gear 116 and the toner-supply roller gear 121 to transmit a driving force between the developer roller gear 116 and the toner-supply roller gear 121. The photoconductor gear 114, the developer roller gear 116, the idle gear 127, the toner-supply roller gear 121, and the agitator gear 126 are sequentially arranged and engaged with each other.

A driving unit (not shown) such as a motor is installed in the case 101. When the developing unit 110 is installed in the case 101, the driving unit is connected to the photoconductor gear 114 to drive the same. The driving unit may directly engage with the photoconductor gear 114 or may be connected to the photoconductor gear 114 through a coupler (not shown). Such a connection between the driving unit and the photoconductor gear 114 is well known to those of ordinary skill in the art. Thus, a detailed description thereof will be omitted.

The idle gear 127 includes a portion engaging with the developer roller gear 116 and a portion engaging with the toner-supply roller gear 121, the portions having different diameters to change the speed of the toner-supply roller gear 121. More specifically, the idle gear 127 includes a first idle gear portion 128 engaged with the developer roller gear 116 and a second idle gear portion 129 engaged with the toner-supply roller gear 121. The second idle gear portion 129 has a smaller diameter than the first idle gear portion 128 to rotate the toner-supply roller gear 121 at a speed lower than that of the idle gear 127.

Also, the toner-supply roller gear 121 includes a portion engaging with the idle gear 127 and a portion engaging with the agitator gear 126, the portions having different diameters to change the speed of the agitator gear 126. More specifically, the toner-supply roller gear 121 includes a first gear portion 122 engaged with the second idle gear portion 129 and a second gear portion 123 engaged with the agitator gear 126. The second gear portion 123 has a smaller diameter than the first gear portion 122 to rotate the agitator gear 126 at a speed lower than that of the toner-supply roller gear 121.

When the electrophotographic image forming apparatus 100 is directed to perform a printing operation, the driving unit rotates the photoconductor gear 114 clockwise and therefore the photoconductor 113 is also rotated clockwise. The motion of the driving unit is sequentially transmitted to the photoconductor gear 114, the developer roller gear 116, the idle gear 127, the toner-supply roller gear 121, and the agitator gear 126. The developer roller gear 116 and the toner-supply roller gear 121 are rotated counterclockwise, and therefore the developer roller 115 and the toner-supply roller 120 that are coaxially connected to the developer roller gear 116 and the toner-supply roller gear 121, respectively, are also rotated in the counterclockwise direction. The idle gear 127, the agitator gear 126, and the agitator 125 coaxially connected to the agitator gear 126 are rotated clockwise.

As described above, a developing unit of the present invention has a simple structure for driving rotary components included in the developing unit. For example, the developing unit only uses a single idle gear. Therefore, the developing unit can have a small size, and can be manufactured with less cost and operate with high reliability.

Further, since the number of gears included in the developing unit is reduced, the possibility of jitter is decreased and thereby high quality images can be printed.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A developing unit comprising:

a photoconductor to form an electrostatic latent image thereon;

a developer roller to develop the electrostatic latent image into a visible toner image by applying toner to the photoconductor;

a toner-supply roller to supply the toner to the developer roller;

an agitator to agitate the toner to supply the toner to the toner-supply roller;

a photoconductor gear formed on a side of the photoconductor, to be rotated by an external driving force;

a developer roller gear formed on a side of the developer roller and engaged with the photoconductor gear to be rotated by the photoconductor gear;

an idle gear engaged with the developer roller gear to be rotated by the developer roller gear;

a toner-supply roller gear formed on a side of the toner-supply roller and engaged with the idle gear to be rotated by the idle gear; and an agitator gear formed on a side of the agitator and engaged with the toner-supply roller gear to be rotated by the toner-supply roller gear.

2. The developing unit of claim 1, wherein the toner-supply roller gear includes:

a first gear portion engaged with the idle gear; and a second gear portion formed coaxially with the first gear portion and engaged with the agitator gear, wherein the first gear portion and the second gear portion have different diameters.

3. The developing unit of claim 1, wherein the idle gear includes:

a first idle gear portion engaged with the developer roller gear; and a second idle gear portion formed coaxially with the first idle gear portion and engaged with the toner-supply roller gear, wherein the first idle gear portion and the second idle gear portion have different diameters.

4. The developing unit of claim 1, wherein the idle gear is the only idle gear used in driving of the photoconductor gear, the developer roller gear, the toner-supply roller gear, and the agitator gear.

5. An electrophotographic image forming apparatus comprising:

a case;

a driving unit installed in the case; and a developing unit removably installed in the case, the developing unit comprising:

a photoconductor to form an electrostatic latent image thereon, a developer roller to develop the electrostatic latent image into a visible toner image by applying a toner to the photoconductor, a toner-supply roller to supply the toner to the developer roller, an agitator to agitate the toner to supply the toner to the toner-supply roller, a photoconductor gear formed on a side of the photoconductor, rotatable by the driving unit a developer roller gear formed on a side of the developer roller and engaged with the photoconductor gear to be rotated by the photoconductor gear, an idle gear engaged with the developer roller gear to be rotated by the developer roller gear, a toner-supply roller gear formed on a side of the toner-supply roller and engaged with the idle gear to be rotated by the idle gear, and an agitator gear formed on a side of the agitator and engaged with the toner-supply roller gear to be rotated by the toner-supply roller gear.

6. The electrophotographic image forming apparatus of claim 5, wherein the idle gear is the only idle gear used in driving of the photoconductor gear, the developer roller gear, the toner-supply roller gear, and the agitator gear.

7. The electrophotographic image forming apparatus of claim 5, wherein the toner-supply roller gear includes:

a first gear portion engaged with the idle gear; and a second gear portion formed coaxially with the first gear portion and engaged with the agitator gear, wherein the first gear portion and the second gear portion have different diameters.

8. The electrophotographic image forming apparatus of claim 5, wherein the idle gear includes:

a first idle gear portion engaged with the developer roller gear; and a second idle gear portion formed coaxially with the first idle gear portion and engaged with the toner-supply roller gear, wherein the first idle gear portion and the second idle gear portion have different diameters.

9. A developing unit comprising:

a photoconductor gear to rotate a photoconductor drum engaged with and driven by an external drive gear;

a developer roller gear engaged with and driven by the photoconductor gear to rotate a developer roller;

an idle gear engaged with and driven by the developer roller gear to drive a toner-supply roller gear;

the toner-supply roller gear engaged with and driven by the idle gear to rotate a toner-supply roller; and an agitator gear engaged with and driven by the toner-supply gear to rotate an agitator.

10. The developing unit of claim 9, wherein the idle gear is the only idle gear used in driving of the photoconductor gear, the developer roller gear, the toner-supply roller gear, and the agitator gear.

11. The developing unit of claim 9, wherein the developer roller gear and the toner-supply roller gear have different diameters.

12. The developing unit of claim 9, further comprising:

a housing, wherein the housing comprises:

a side to rotatably support the photoconductor gear, the developer roller gear, the idle gear, the toner-supply roller gear, and the agitator gear, another side to rotatably support the photoconductor drum, developer roller, toner-supply roller, and agitator between the two sides, a bottom portion to contain toner, and a handle to install and remove the developing unit.

13. A developing unit comprising:

a photoconductor gear, a developer roller gear, a toner-supply roller gear and an agitator gear to drive a photoconductor drum, a developer roller, a toner-supply roller, and an agitator, respectively;

a driving unit engaged to one of the photoconductor gear, developer roller gear, toner-supply roller gear and agitator gear to rotate the engaged gear; and an idle gear engaging two other of these gears, wherein rotation of the driving unit causes rotation in each of the other gears, the idle gear is the only idle gear used in driving the photoconductor, developer roller, toner-supply roller, and agitator gears, and the toner-supply roller gear includes:

a first gear portion engaged with the idle gear, and a second gear portion formed coaxially with the first gear portion and engaged with the agitator gear, wherein the first gear portion and the second gear portion have different diameters.

14. A developing unit comprising:

a photoconductor gear, a developer roller gear, a toner-supply roller gear and an agitator gear to drive a photoconductor drum, a developer roller, a toner-supply roller, and an agitator, respectively:

a driving unit engaged to one of the photoconductor gear, developer roller gear, toner-supply roller gear and agitator gear to rotate the engaged gear; and an idle gear engaging two other of these gears, wherein rotation of the driving unit causes rotation in each of the other gears, and wherein the idle gear includes:

a first idle gear portion engaged with the developer roller gears, and a second idle gear portion formed coaxially with the first idle gear portion and engaged with the toner-supply roller gear, wherein the first idle gear portion and the second idle gear portion have different diameters.

15. A developing unit comprising:

a photoconductor gear, a developer roller gear, a toner-supply roller gear and an agitator gear to drive a photoconductor drum, a developer roller, a toner-supply roller, and an agitator, respectively;

a driving unit engaged to one of the photoconductor gear, developer roller gear, toner-supply roller gear and agitator gear to rotate the engaged gear; and an idle gear engaging two other of these gears, wherein rotation of the driving unit causes rotation in each of the other gears, and wherein:

the idle gear comprises:

a first idle gear portion engaged with the developer roller gear, and a second idle gear portion formed coaxially with the first idle gear portion and engaged with the toner-supply roller gear, wherein the first idle gear portion and the second idle gear portion have different diameters; and the toner-supply roller gear comprises:

a first gear portion engaged with the idle gear, and a second gear portion formed coaxially with the first gear portion and engaged with the agitator gear, wherein the first gear portion and the second gear portion have different diameters.

16. A method of printing an image from a photoconductor in a developing unit using a simple gear train having a single idle gear, comprising:

rotating an external drive gear engaged with and driving a photoconductor gear to rotate a photoconductor drum in a developing unit engaged with and driving a developer roller gear to rotate a developer roller in the developing unit engaged with and driving an idle gear engaged with and driving a toner-supply roller gear to rotate a toner-supply roller in the developing unit engaged with and driving an agitator gear to rotate an agitator in the developing unit;

agitating a toner in the developing unit by rotation motion of the agitator to supply toner to the rotating toner-supply roller;

supplying the toner to the rotating developer roller by rotation motion of the toner-supply roller;

applying the toner to the rotating photoconductor roller by rotation motion of the developer roller to develop an electrostatic latent image formed on the photoconductor; and transferring the toner image to a print medium.

17. The method as defined in claim 16, further comprising;

driving a first gear portion of the idle gear by rotation of the developer roller gear;

rotating a second gear portion of the idle gear formed coaxially with the first gear portion of the idle gear, wherein the first and second gear portions of the idle gear have different diameters; and driving the toner-supply roller gear by engagement with the second portion of the idle gear.

18. The method as defined in claim 16, further comprising:

driving a first gear portion of the toner-supply roller gear by rotation of the idle gear;

rotating a second gear portion of the toner-supply roller gear formed coaxially with the first gear portion of the toner-supply roller gear, wherein the first and second gear portions of the toner-supply roller gear have different diameters; and driving the agitator gear by engagement with the second portion of the toner-supply roller gear.

* * * * *

UNITED STATES PATENT AND TRADEMARK OFFICE

CERTIFICATE OF CORRECTION

PATENT NO. : 7,430,387 B2
APPLICATION NO. : 11/384539
DATED : September 30, 2008
INVENTOR(S) : Jin-hong Kim et al.

It is certified that error appears in the above-identified patent and that said Letters Patent is hereby corrected as shown below:

Column 8, line 37, change “gears” to --gear--.

Signed and Sealed this

Second Day of December, 2008

JON W. DUDAS
*Director of the United States Patent and Trademark Office*